US007032340B2

(12) United States Patent
Baber et al.

(10) Patent No.: US 7,032,340 B2
(45) Date of Patent: Apr. 25, 2006

(54) BREECH CONSTRUCTION FOR FIREARMS

(76) Inventors: Jerry Baber, 1356 Enterprise Rd., Piney Flats, TN (US) 37686; Boje Cornils, 5577 Maxine St., Russellville, TN (US) 37860

( * ) Notice: Subject to any disclaimer, the term of this patent is extended or adjusted under 35 U.S.C. 154(b) by 0 days.

(21) Appl. No.: 10/648,733

(22) Filed: Aug. 26, 2003

(65) Prior Publication Data

US 2005/0188590 A1 Sep. 1, 2005

(51) Int. Cl.
*F41A 21/48* (2006.01)

(52) U.S. Cl. ..... 42/75.02
(58) Field of Classification Search ..... 42/75.01, 42/75.02, 75.04
See application file for complete search history.

(56) References Cited

U.S. PATENT DOCUMENTS

| | | | | |
|---|---|---|---|---|
| 2,247,011 | A * | 6/1941 | Browning | 42/18 |
| 2,368,160 | A * | 1/1945 | Roemer | 42/75.01 |
| 2,782,688 | A * | 2/1957 | Leek et al. | 89/199 |
| 3,079,718 | A * | 3/1963 | Akkyn | 42/69.03 |
| 4,693,170 | A * | 9/1987 | Atchisson | 89/149 |
| 6,606,812 | B1 * | 8/2003 | Gwinn, Jr. | 42/75.02 |
| 6,739,082 | B1 * | 5/2004 | Christensen | 42/6 |

* cited by examiner

*Primary Examiner*—Stephen M. Johnson

(57) ABSTRACT

In an autoloading gun construction having the breach end of a barrel removably assembled to the forward end of a barrel extension which is positioned between and secured to wall sections of two opposing receiver plates of a receiver section, the improvement comprising an aperture formed thru each wall section, and a weld formed between edge portions of each aperture and adjacent portions of the barrel extension.

10 Claims, 1 Drawing Sheet

PRIOR ART - U.S. Patent 4,693,170

BREECH CONSTRUCTION FOR FIREARMS

BACKGROUND OF THE INVENTION

1. Field

This invention relates in general to repeating firearms, and relates in particular to autoloading shotguns and other such firearms.

2. Prior Art

Past efforts to design improved, practical autoloading shotguns generally having been constrained by the effects of firing recoil, or by inadequately considering the effects of recoil when designing the gun. The term "autoloading" is herein used to denote a gun which, when fired, automatically ejects the spent shell and loads a fresh round from a magazine, and includes semi-automatic as well as full-automatic firing modes.

Although recoil affects any firearm to some degree, the relatively heavy recoil of shotguns is recognized by most shooters. Particularly in larger-gauge shotguns, recoil and percussion can loosen mechanical joints, i.e., riveted, screwed or bolted joints as shown in U.S. Pat. No. 4,693,170, the disclosure of which is hereby incorporated herein by reference, in its entirety. Fatigue of adjacent metal structures also is experienced.

Where dimensionally critical portions of the gun are involved, such as the breech area including the mechanical connection of the barrel to the barrel extension for guns which have a removable barrel, such loosening of joints can compromise smooth action of the autoloading mechanism as well as creating dangerous conditions of misfirings, premature firings, shell jamming and the like.

SUMMARY OF THE INVENTION

An autoloading gun construction having barrel extension means constructed for rapidly receiving cartridges, missile end first, and guiding them into the breach end of a barrel, wherein said extension means is positioned between and secured to wall sections of two opposing receiver plates of a receiver section by welding.

In a much preferred embodiment, quick disconnect means are provided on the extension means and barrel for quickly removing the barrel for renewal or replacement with a barrel of a different type.

BRIEF DESCRIPTION OF THE DRAWINGS

The invention will be further understood from the drawings herein wherein certain structural portions are shown enlarged or out or proportion for clarity and where the same numbering of structures as in U.S. Pat. No. 4,693,170 is used for equivalent structure of the present invention.

DETAILED DESCRIPTION

Figure 6:
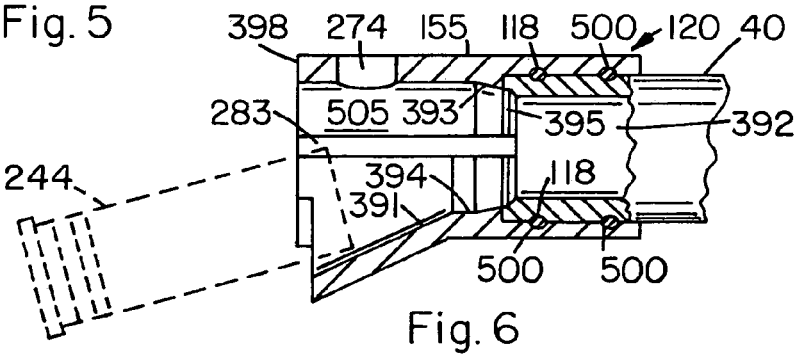
FIG. 6 is a view as in FIG. 31 of said patent with original numbering retained and additional numbering added for the present modifications.

Referring to the drawings and with particular reference to the claims herein, the present construction modifies the connection means between a barrel extension such as item 120 and a barrel such as 40 and also receiver sides such as items (plates) 117L and 117R of the aforesaid U.S. Pat. No. 4,693,170 as shown in FIGS. 2, 3, 13 and 31 thereof. In said patent the connection is made between all three of these structures by four rivets 118 which are headed over (clinched) on the outside of plates 117L arid 117R. In this construction shown particularly in applicants' FIG. 6 taken from FIG. 31 of said patent and wherein additional new numbering as added where necessary for clarity starting at 500, rivets 118 tightly nest in transverse grooves 500 across the top and bottom of the inner end (breech end) of barrel 40 and thereby fix the barrel to barrel extension 120 and thus to receiver section 41 (see aforesaid patent). This structure, of course, prevents removal of the barrel which can cause great inconvenience where it is desired to replace a damaged barrel or to replace the barrel with another type, e.g., from shotgun to rifle.

Referring to the present drawings wherein the numbering of parts, where relevant, is the same as in said U.S. Pat. No. 4,693,170 patent, the barrel extension 120 having shell receiving cavity 505 is preferably formed on the outside surfaces of both sides with locator lands 502 having first edge portions 503 which can be of any configuration but preferably of a shape to coincide substantially with second edge portions 501 of apertures 504 formed thru each side 117L and 117R of receiver section 41. Welds such as 506 are formed between the adjacent edges of the lands, or sides of 120 where lands are not provided, and of apertures 504. In the drawing (FIG. 5) excessive clearance between these adjacent first and second edges is shown, as well as unwelded portions, for clarity. Precision mating of these edges within a few thousandths of an inch, e.g., less than 0.020 in. is highly desirable. The size of lands 502 should be approximately in the proportions shown to assure a joint which is unyielding under rapid fire stresses.

Should it be desired to permanently affix the barrel to the barrel extension as shown in the aforesaid patent, rivets 118 may be employed in conjunction with welds 506. However, in a highly preferred embodiment of the present invention the gun barrel is removably mounted in the forward end of the extension means by a unique and easily disassembled "slot and clip" connector means generally designated 508 and, most preferably, in combination with a barrel clamping mechanism generally designated 510 for tightly securing and stabilizing the barrel within the forward end of the barrel extension.

Figure 1:
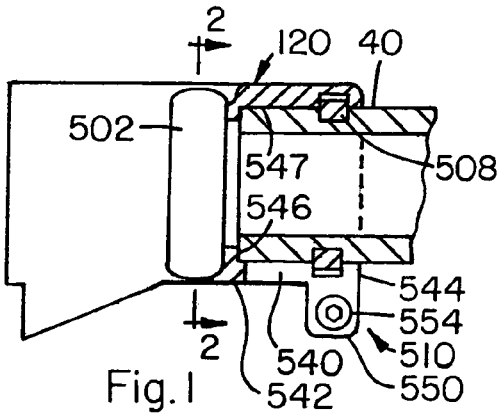
FIG. 1 is a partially longitudinally cross-sectioned side view of the present barrel extension which is similar in some respects to the barrel extension 120 of the aforesaid U.S. Pat. No. 4,693,170.
Figure 2:
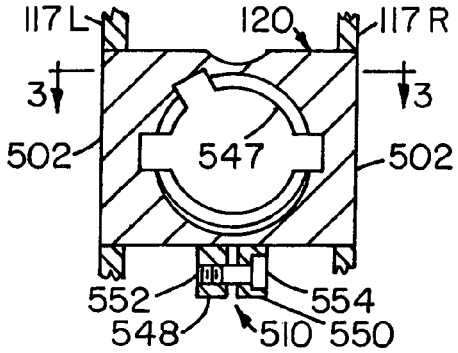
FIG. 2 is a cross-sectional view taken along line 2—2 of FIG. 1.
Figure 3:
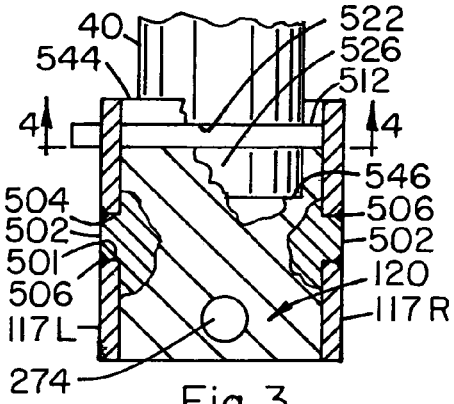
FIG. 3 is a cross-sectional view along line 3—3 in FIG. 2 with structural portions broken away or removed for clarity.
Figure 4:
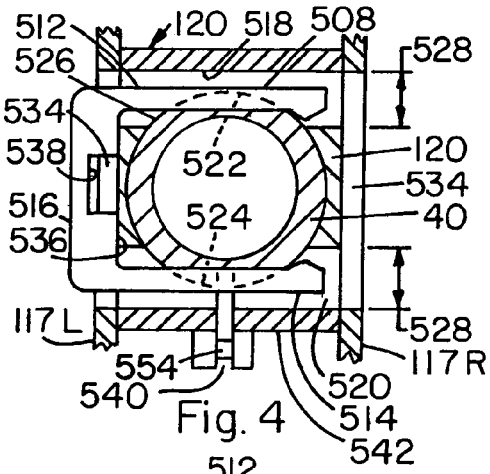
FIG. 4 is a cross-sectional view taken along line 4—∝in FIG. 3 with portions broken away for clarity.
Figure 7:
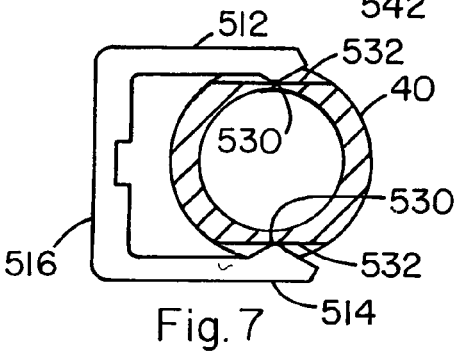
FIG. 7 is a view as in FIG. 4 but shown with the clip in its half-way inserted spread posture.

Clip 508 as shown in FIGS. 4 and 7 comprises a pair of arms 512 and 514 integral with body portion 516 and preferably having rectangular cross-sections. These arms are dimensioned to slide easily thru slots 518 and 520 respectively formed laterally thru extension 120, and thru slots 522 and 524 respectively formed across the top and bottom of breech end 526 of the barrel. The lateral play of these arms in the slots should be just enough, e.g., from about 0.004 in.

to about 0.008 in. to allow easy insertion and sliding of the arms in the slots while preventing longitudinal movement of any significant degree of the barrel relative to the barrel extension. These slots each has a vertical dimension 528 which allows the arms to spread apart as shown in FIG. 7 as cam surfaces 530 on the insertion ends of the arms slide on the bottom surface 532 of each of slots 522 and 524 in the barrel.

Figure 5:
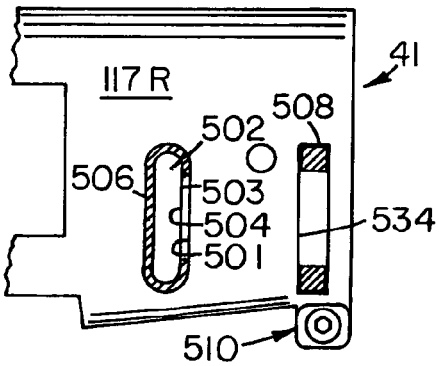
FIG. 5 is a side view as in FIG. 1 with a portion of receiver side 117R in place and welded to the edges of the locator land as indicated by the cross hatched outline, with portions of the weld broken away for clarity.

Clip 508 is made of metal, e.g., stainless steel which is sufficiently resilient to spring back into the locking position as in FIG. 4 as the clip is fully inserted thru the slots. As shown in FIG. 5, an opening 534 is formed thru each plate 117L and 117R to allow insertion of the arms and to allow the inner edge 536 of body portion 516 to lie flush with the barrel extension side, it is preferred that a cut-out 538 be provided in said inner edge 536 to allow for the insertion of a tool such as a screwdriver or knife blade to assist in extracting the clip, if necessary. It is noted that the clip 508 can be inserted thru either side of the receiver section.

As shown in the drawings, the aforementioned barrel clamping mechanism comprises a slot 540 Cut longitudinally thru the bottom wall portion 542 of the forward portion of the barrel extension 120 from the front edge 544 thereof back to approximately the barrel abutment shoulder 546 on the wall 547 of the barrel extension 120 bore. Extending down on the sides of slot 540 are projections 548 and 550. One projection is provided with a threaded bore 552 which receives a tightening means such as a bolt or Allen screw or the like 554. The clearance between the extension bore wall 547 and the barrel breech end 526 is small such that a tightening turn or so of screw 554 will squeeze wall 547 against breech end 526 of the barrel and further secure it within the extension bore.

The invention has been described in detail with particular reference to preferred embodiments thereof, but it will be understood that variations and modifications will be effected with the spirit and scope of the invention.

I claim:

1. In an autoloading gun construction having a breech end of a barrel assembled in a forward end portion of a barrel extension means, which extension means has an inner end portion formed with a flared shell receiving cavity for rapidly receiving cartridges (244), missile end first, and guiding them into said breech end, wherein said extension means is positioned between and secured by joint structure to wall sections of two opposing receiver plates of a receiver section, and wherein said wall sections each has a substantially planar outer surface, said joint structure comprising cooperating first edge portions of locator lands projecting outwardly from opposite sides of said barrel extension means, and second edge portions of aperture means formed thru each said wall section, wherein said lands extend into said aperture means and wherein said first and second edge portions are welded together.

2. The gun construction of claim 1 wherein each said land means extends into an adjacent aperture means substantially to the plane of each said outer surface for enhancing weld strength therebetween.

3. The gun construction of claim 2 wherein said wall sections and said barrel extension means are of stainless steel and wherein said first and second edge portions are each dimensioned to position said barrel extension means precisely at a specific location between said wall sections for welding.

4. The gun construction of claim 1 wherein cooperating elements of connector means are provided on said breech end of said barrel and in said forward end of said barrel extension means whereby said barrel can be removed from said barrel extension means.

5. The gun construction of claim 4 wherein said cooperating elements comprise aligned slot means in an outer surface of said breech end of said barrel and in wall portions forming an inner surface of said barrel extension means, and spring clip means having arm means inserted thru said aligned slot means and adapted to bear laterally against side portions of each said slot means to thereby prevent longitudinal movement of said barrel with respect to said barrel extension means.

6. The gun construction of claim 5 wherein clamping means is provided on said barrel extension means for tightening portions of said barrel extension means around said breech end of said barrel.

7. The gun construction of claim 2 wherein cooperating elements of removable connector means are provided on said breech end of said barrel and in a barrel receiving bore in said forward end portion of said barrel extension means whereby said barrel can be removed from said barrel extension means.

8. The gun construction of claim 7 wherein said cooperating elements comprise aligned slot means in an outer surface of said breech end of said barrel and in wall portions forming the inner surface of said barrel receiving bore, and spring clip means having arm means inserted thru said aligned slot means and adapted to bear laterally against side portions of each said slot means to thereby prevent longitudinal movement of said barrel with respect to said barrel extension means.

9. The gun construction of claim 8 wherein clamping means is provided on said barrel extension means for tightening portions of said barrel extension means around said breech end of said barrel.

10. The gun construction of claim 9 where said clamping means comprises slot means formed substantially longitudinally in wall means defining said forward portion of said barrel extension means and said barrel receiving bore whereby said wall means can be flexed inwardly to reduce the diameter of said barrel receiving bore, and tightening means is provided and adapted to engage portions of said wall means on either side of said slot means and operable to reduce the width of said slot means to flex said wall means inwardly into tight engagement with the breech end of said barrel.

* * * * *